US009752600B2

(12) United States Patent
Hoff et al.

(10) Patent No.: US 9,752,600 B2
(45) Date of Patent: Sep. 5, 2017

(54) ENERGY DISSIPATOR AND ASSOCIATED SYSTEM FOR USE IN SUMPED FLOW-THROUGH MANHOLES

(71) Applicant: Momentum Environmental, LLC, Blaine, MN (US)

(72) Inventors: Lance Hoff, Blaine, MN (US); Daniel Joseph Murphy, IV, Minneapolis, MN (US)

(73) Assignee: Momentum Environmental LLC, Andover, MN (US)

( * ) Notice: Subject to any disclaimer, the term of this patent is extended or adjusted under 35 U.S.C. 154(b) by 0 days.

(21) Appl. No.: 14/724,956

(22) Filed: May 29, 2015

(65) Prior Publication Data

US 2015/0345523 A1 Dec. 3, 2015

Related U.S. Application Data

(60) Provisional application No. 62/006,430, filed on Jun. 2, 2014.

(51) Int. Cl.
*E03F 5/02* (2006.01)
*E03F 5/14* (2006.01)
(Continued)

(52) U.S. Cl.
CPC ..... *F15D 1/025* (2013.01); *E03F 1/00* (2013.01); *E03F 5/02* (2013.01); *E03F 5/021* (2013.01);
(Continued)

(58) Field of Classification Search
CPC ..... E03F 1/00; E03F 5/02; E03F 5/021; E03F 5/0401; E03F 5/0403; E03F 5/041;
(Continued)

(56) References Cited

U.S. PATENT DOCUMENTS 1,793,599 A * 2/1931 Egan ..... E03F 5/046 210/170.03
2,216,300 A * 10/1940 Shenk ..... B01D 21/0033 210/307
(Continued)

FOREIGN PATENT DOCUMENTS

DE 3305344 * 9/1984

OTHER PUBLICATIONS

"45 Minute Stormwater Sediment Solution", printed from http://upstreamtechnologies.us/wp-content/uploads/2015/05/SAFL-Baffle-Data-Sheet-Web-Quality-5-9-15-Revision-USA.pdf, publicly available at least as early as May 15, 2015 (2 pages).

*Primary Examiner* — Christopher Upton
(74) *Attorney, Agent, or Firm* — JoAnn M. Seaton; Griffiths & Seaton PLLC

(57) ABSTRACT

An energy dissipator for use in a sumped manhole includes a sheet member. The sheet member defines a downstream surface, an upstream surface opposite the downstream surface, and opposing side edges each extending between the downstream surface and the upstream surface. The sheet member includes a plurality of apertures. Each of the plurality of apertures extends through both the downstream surface and the upstream surface. The sheet member extends in an arcuate manner between the opposing side edges. The dissipator is configured to intercept fluid flow within the manhole to decrease energy and control flow dynamics within the manhole.

19 Claims, 11 Drawing Sheets

(51) Int. Cl.

| | |
|---|---|
| ***F15D 1/02*** | (2006.01) |
| ***E03F 5/04*** | (2006.01) |
| ***F15D 1/00*** | (2006.01) |
| ***E03F 1/00*** | (2006.01) |

(52) U.S. Cl.
CPC ..... *E03F 5/0403* (2013.01); *E03F 5/14* (2013.01); *F15D 1/0005* (2013.01); *Y10T 29/49828* (2015.01)

(58) Field of Classification Search
CPC ... E03F 5/14; B01D 21/0033; B01D 21/2405; B01D 21/2416; F15D 1/0005
USPC .... 210/747.2, 747.3, 800, 170.03, 498, 519, 210/521, 532.1, 538
See application file for complete search history.

(56) References Cited

U.S. PATENT DOCUMENTS

| | | | | |
|---|---|---|---|---|
| 4,132,652 | A | 1/1979 | Anderson et al. | |
| 4,157,969 | A | 6/1979 | Thies | |
| 4,543,114 | A * | 9/1985 | Beattie | B01D 35/02 210/498 |
| 4,689,145 | A | 8/1987 | Mathews et al. | |
| 5,204,000 | A * | 4/1993 | Steadman | B01D 17/0208 210/519 |
| 5,405,539 | A | 4/1995 | Schneider | |
| 6,022,474 | A * | 2/2000 | MacKelvie | B01D 29/356 210/498 |
| 6,126,817 | A * | 10/2000 | Duran | E03F 5/16 210/532.1 |
| 6,524,473 | B2 | 2/2003 | Williamson | |
| 6,955,756 | B2 | 10/2005 | Fallon | |
| 7,011,743 | B2 | 3/2006 | Use et al. | |
| 7,033,496 | B2 | 4/2006 | Thacker et al. | |
| 7,282,143 | B2 | 10/2007 | Liao | |
| 7,332,091 | B2 | 2/2008 | Peters, Jr. et al. | |
| 7,534,355 | B2 | 5/2009 | Lockerman et al. | |
| 7,544,303 | B2 | 6/2009 | Frink | |
| 8,017,004 | B2 * | 9/2011 | Crumpler | E03F 1/00 210/170.03 |
| 8,343,357 | B2 | 1/2013 | Horner | |
| 8,663,466 | B2 | 3/2014 | Braunwarth et al. | |
| 8,715,507 | B2 | 5/2014 | Gulliver et al. | |
| 2008/0035570 | A1 * | 2/2008 | Lugo | E03F 1/00 210/650 |
| 2008/0283475 | A1 * | 11/2008 | Benty | B01D 21/0012 210/800 |

* cited by examiner

ENERGY DISSIPATOR AND ASSOCIATED SYSTEM FOR USE IN SUMPED FLOW-THROUGH MANHOLES

This application is a non-provisional application of and claims priority to U.S. Provisional Patent Application No. 62/006,430, filed Jun. 2, 2014, which is incorporated herein by reference.

BACKGROUND OF THE INVENTION

Sumped manholes are commonly used in sewer systems to temporarily collect settleable solids until they can be removed from the system during routine maintenance. As illustrated in FIGS. 1 and 2, a typical sumped manhole 12 includes a cylindrical manhole sidewall 14 and a bottom 16. An inlet pipe 18 extends into manhole sidewall 14 via an inlet hole 20 in manhole sidewall 14, and an outlet pipe 22 extends into manhole sidewall 14 via an outlet hole 24 in manhole sidewall 14. Both inlet pipe 18 and outlet pipe 22 are spaced above bottom 16 of sumped manhole 12 to form a sump 26 below inlet and outlet pipes 18 and 22 above bottom 16 of sumped manhole 12.

In a drain system 10 including a typical sumped manhole 12, fluids flow into sumped manhole 12 via inlet pipe 18 and out of sumped manhole 12 via outlet pipe 22, as generally indicated with arrows 28. The fluids moving from inlet pipe 18 to outlet pipe 22 carry solids, such as sediment and larger waste items, and drop at least a portion of the solids carried therewith into sump 26. The solids collected in sump 26 include sediment 32, which collects on bottom 16 of sumped manhole 12 for subsequent removal during periods with a low flow rate. During periods of high flow rates, the high energy flow jet substantially linearly extends between inlet pipe 18 and outlet pipe 22 introducing a circular flow pattern, as generally indicated by arrow 30 in FIG. 2, below the primary flow 28. Circular flow pattern 30 interrupts collected sediment 32 in sump 26 resulting in scour of the collected sediment 32 in sumped manhole 12. Scour is the undesirable process of high fluid flows transferring sufficient energy to previously settled sediment 32 in a manner re-suspending sediment 32 in the water column and subsequently washing such sediment 32 out of sumped manhole 12 and downstream. In one observed experiment and as illustrated in FIG. 2, due at least in part to circular flow pattern 30, sediment scoured from a downstream portion of sump 26 to a more upstream portion of sump 26 relative to inlet pipe 18, resulting in a higher total sediment height in sump 26 as compared to an initial solids level, which is generally indicated with a dashed line at 34.

Until recently, the effectiveness of standard sumped manholes 12 at removing settleable solids has not been quantified, and was assumed to be marginal. Due to the assumed marginal removal efficiencies of standard sumped manholes 12, several products have been developed that claim to greatly improve the performance of sumped manholes 12 via the addition of internal components to sumped manhole 12. These products focus on designs that claim to increase removal efficiencies, reduce scour, or both.

One such product is a floatables skimmer 40 as illustrated, for example, in FIGS. 3 and 4 as added to sumped manhole 12 as originally presented in FIGS. 1 and 2. Skimmer 40 is formed of a substantially solid material restricting fluid flow therethrough and is coupled to manhole sidewall 14 on either side of outlet pipe 22. In this manner, skimmer 40 extends both above and below a top and a bottom of outlet pipe 22, respectively. While skimmer 40 serves to decrease floating larger solids and smaller solids alike from rushing with the fluid flow 28 into outlet pipe 22, skimmer 40 also introduces disruptions to fluid flow within sumped manhole 12. As illustrated in FIGS. 3 and 4, for example, the circular arrows 72 generally indicate vortex flow patterns 42, which scour sediment 32 on each opposing side of outlet pipe 22. The scour re-suspends sediment 32 that was previously collected in those areas as shown by the original sediment line 34 in FIG. 4. In recent years, several publicly funded studies have been performed to determine the effectiveness of standard sumped manholes with and without flow treatment products using standardized removal efficiency and scour testing. The results of these studies show that the existing product-modified systems can provide increased removal efficiencies over standard sumped manholes, but can also fall short of desired sumped manhole removal efficiencies.

Furthermore, some systems use internal components to swirl water, which increases particle travel paths, consequently resulting in increased removal efficiencies. While swirling low flows have proven to increase removal efficiencies, swirling flows also have the effect of creating vortices during high flows, greatly increasing scour in comparison to standard sumped manholes. Scour testing has revealed that scour in standard sumped manholes in product-modified systems is a more important factor than removal efficiency in determining a treatment devices typical annualized removal efficiency. Essentially, the removal efficiency of a structure is negated if it is not designed to retain previously settled solids during high flows.

Other storm water treatment systems configured to improve the performance of standard sumped manholes by focusing on scour suppression, such systems often utilize a horizontal false floor. While a false floor is relatively effective at suppressing scour by providing a boundary between previously settled solids and high flows, the false floors introduce negative side effects such as reducing sediment removal efficiencies by effectively reducing the water depth and creating an obstruction for routine inspection and maintenance. Use of false floors is generally restricted for use within circular manholes and such false floors are not retrofittable, thereby limiting the overall applicability of such false floors.

In view of the above-described issues with existing storm water systems, there is room for improvement of standard sumped manholes and modifying products currently on the market.

SUMMARY OF THE INVENTION

One aspect of the present invention relates to an energy dissipator for use in a sumped manhole and including a sheet member. The sheet member defines a downstream surface, an upstream surface opposite the downstream surface, and opposing side edges each extending between the downstream surface and the upstream surface. The sheet member includes a plurality of apertures. Each of the plurality of apertures extends through both the downstream surface and the upstream surface. The sheet member extends in an arcuate manner between the opposing side edges. The dissipator is configured to intercept fluid flow within the manhole to decrease energy and control flow dynamics within the manhole. Other apparatus, assemblies, systems and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

In view of issues identified with prior art sumped manhole systems, the current invention provides settleable solids management systems and methods including an energy dissipator working alone or in tandem with a floatables skimming device to increase removal of solids and reduce the scour of settleable solids in sumped flow-through manholes. In one embodiment, the system according to one embodiment of the current invention includes an energy-dissipating device on one or more of the inlets to the sumped manhole. The energy-dissipating device, or dissipator, is configured for installation within the sumped flow-through manhole in an arcuate shape curving away from the inlet pipe. The dissipator includes a plurality of apertures therein distributed in a pattern selected to dissipate more energy at selected portions thereof. In one example, the dissipator is installed to taper back toward the sidewall of the sumped flow-through manhole toward a bottom of the dissipator. A dissipator according to the present invention increases head losses as well as solids removal efficiencies of the drain system incorporating the dissipator.

While the dissipator is used alone in a sumped flow-through manhole per embodiments of the present invention, in some embodiments, the dissipator is used in tandem with a floatables skimmer positioned near an outlet pipe of the sumped flow-through manhole. The dissipator provides similar benefits when used with a floatables skimmer as when used alone.

Systems and components thereof according to the present invention improve upon prior art technologies by providing systems and associated methods to suppress scour within a sumped flow-through manhole thereby increasing efficiencies in settleable solids removal as compared to standard sumped manholes and improving access for inspection and maintenance by utilizing vertically oriented components placed as close to the manhole sidewalls, and therefore, the corresponding inlet or outlet pipe, as possible. Components of the settleable solids management system according to the present invention may be used to retrofit existing standard sumped manholes of any size and shape or as part of a new sumped flow-through manhole assembly.

Figure 1:
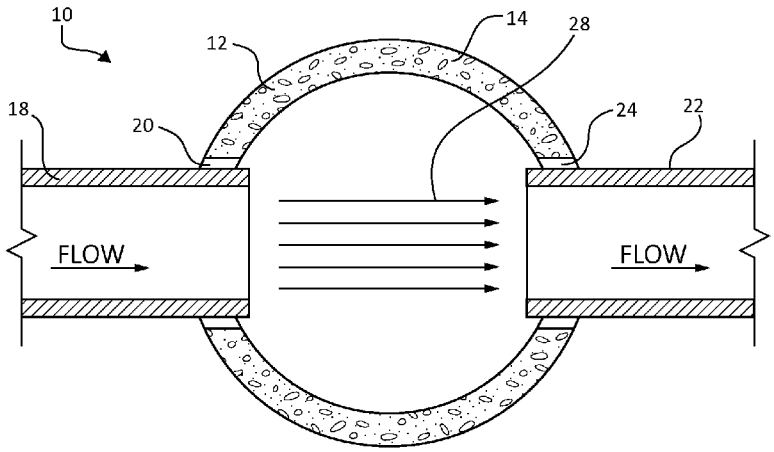
FIG. 1 PRIOR ART
FIG. 1 is top view of a drain system of the prior art with a portion of the included sumped manhole removed for illustrative purposes.
Figure 2:
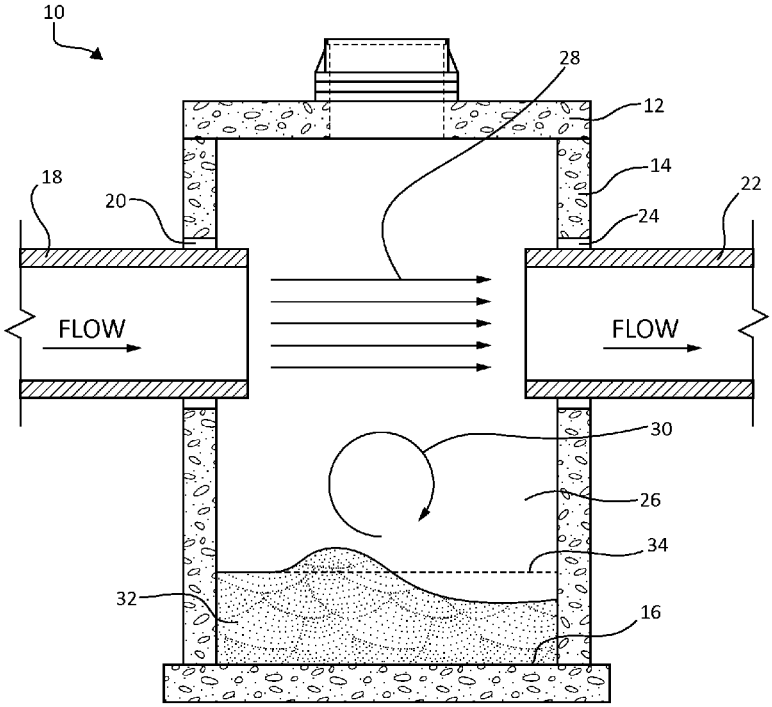
FIG. 2 PRIOR ART
FIG. 2 is a side view of the drain system of FIG. 1 with a portion of an included manhole sidewall removed for illustrative purposes.
Figure 3:
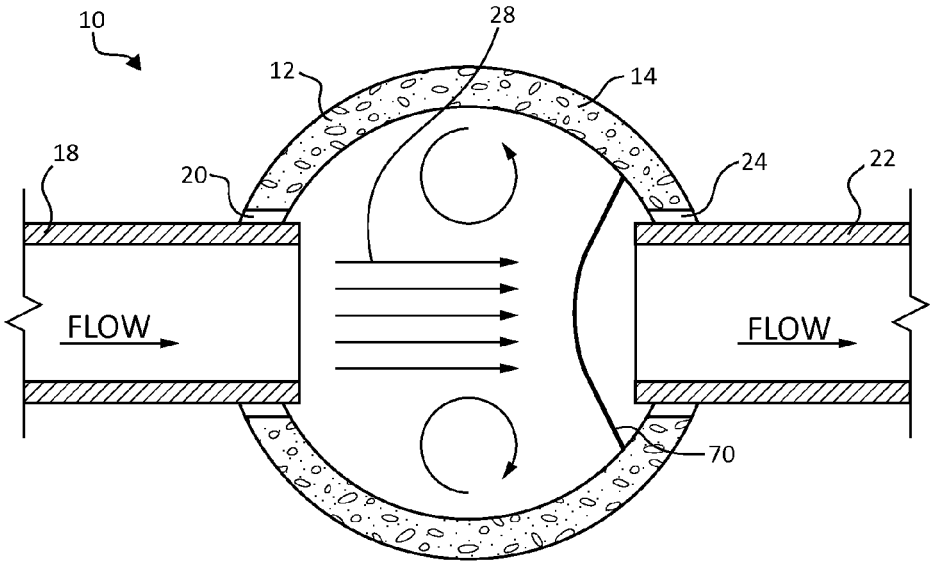
FIG. 3 PRIOR ART
FIG. 3 is top cross-sectional view of a drain system of the prior art including a floatables skimmer installed therein.
Figure 4:
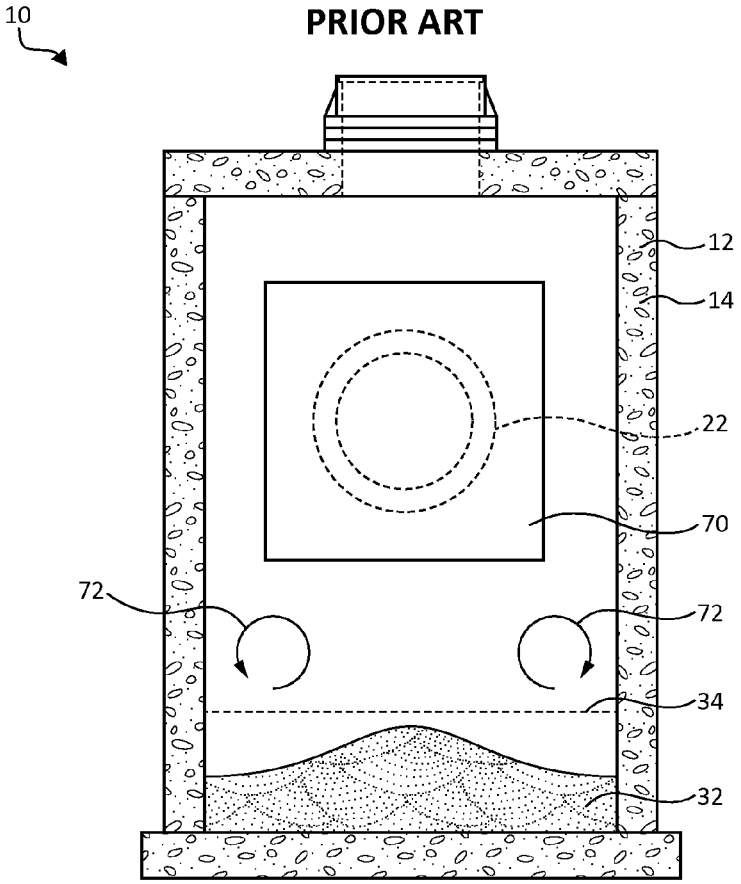
FIG. 4 PRIOR ART
FIG. 4 is a side view of a drain system of FIG. 3 with a portion of the manhole sidewall removed for illustrative purposes.
Figure 5:
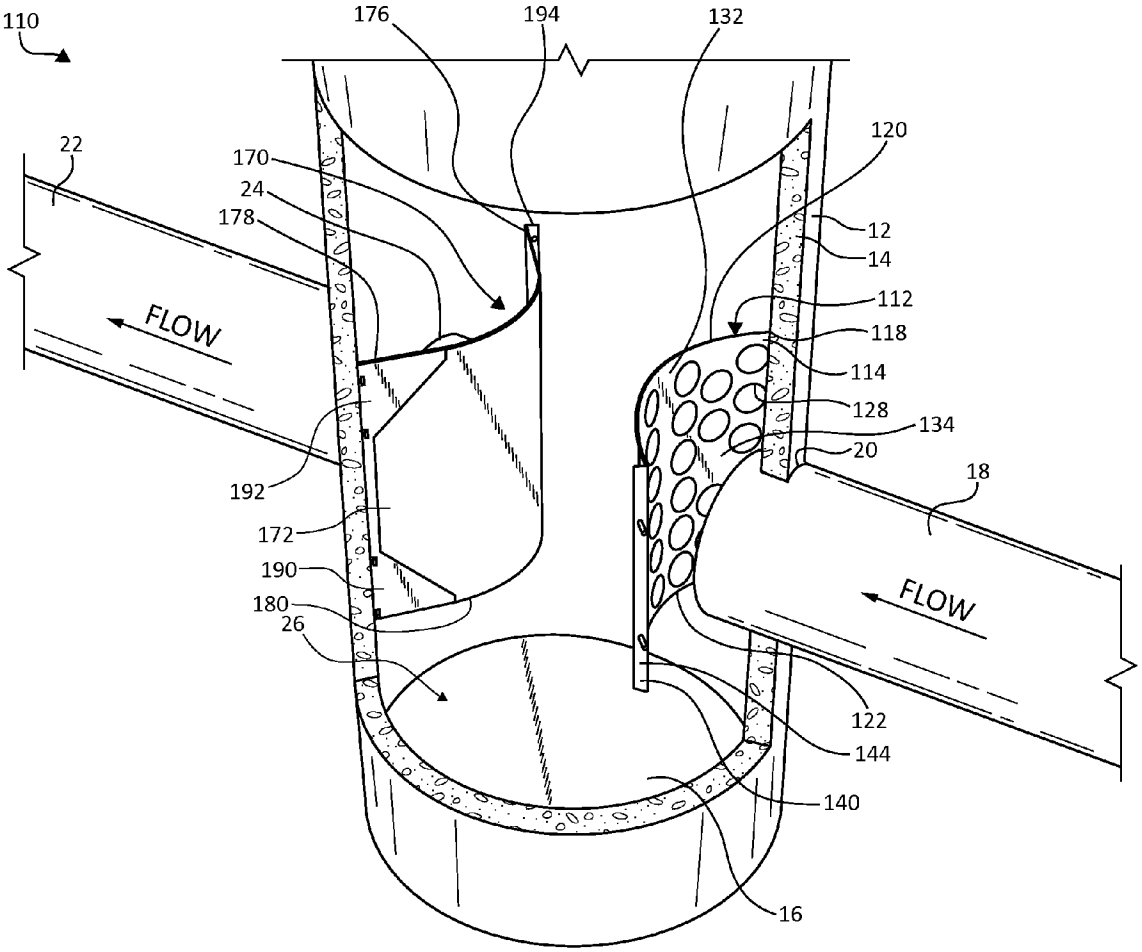
FIG. 5 is a perspective view illustration of a drain system with a portion of an included sumped manhole removed for illustrated purposes, according to one embodiment of the present invention.
Figure 6:
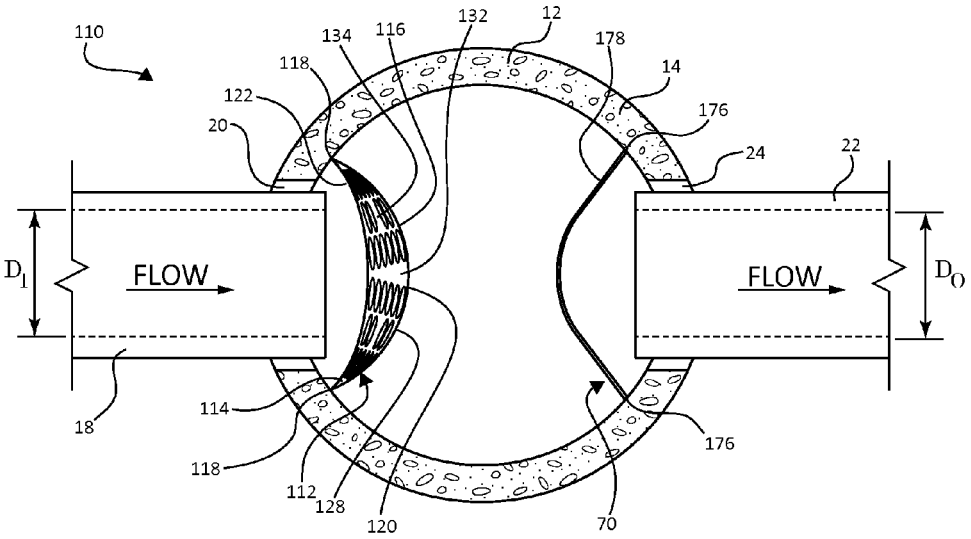
FIG. 6 is a top view of the drain system of FIG. 5 with a portion of the sumped manhole removed for illustrated purposes, according to one embodiment of the present invention.
Figure 7:
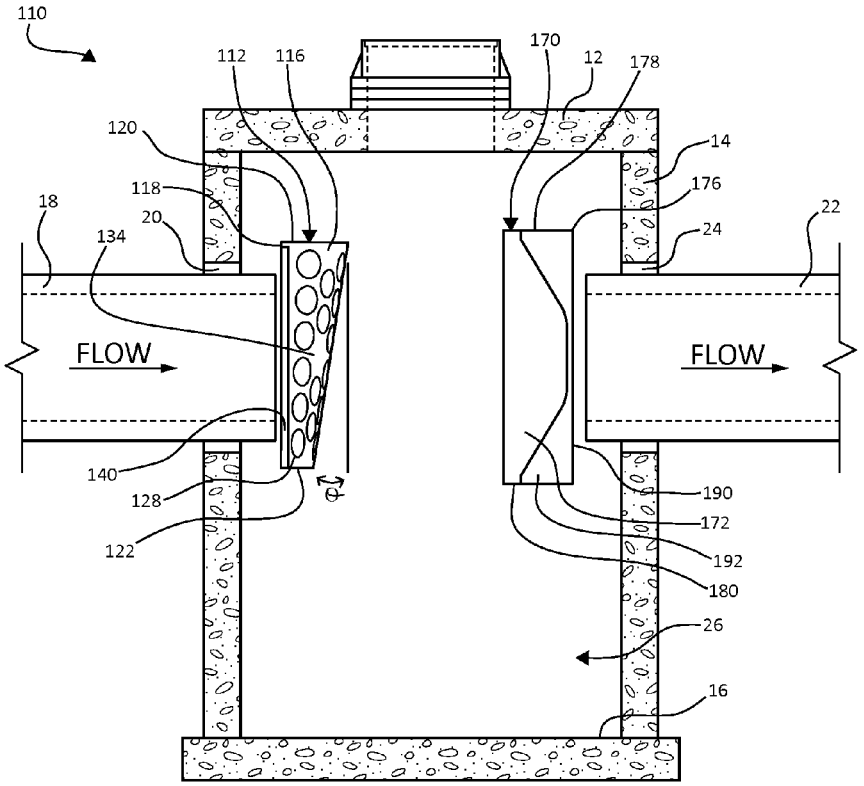
FIG. 7 is a right view of the drain system of FIG. 6 with a portion of the sumped manhole removed for illustrated purposes, according to one embodiment of the present invention.

For example, FIGS. 5-7 collectively illustrate one embodiment of a drain system 110 in accordance with the present invention. Drain system 110 includes a sumped flow through sumped manhole 12, an inlet pipe 18, and outlet pipe 22, and an energy dissipator 112. As described above with respect to the prior art, in one example, inlet pipe 18 extends through an inlet hole 20 in manhole sidewall 14, and outlet pipe 22 extends partially into manhole sidewall 14 through outlet hole 24 in manhole sidewall 14. As illustrated in the embodiment of FIGS. 5-7, inlet hole 20 and outlet hole 24 are positioned diametrically opposed to one another, that is, at about 180° relative to each other about a circumference of sumped flow-through sumped manhole 12. Other positionings of outlet pipe 22 relative to inlet pipe 18 are also contemplated for use with this innovation. Sumped manhole 12, inlet pipe 18, and outlet pipe 22 may each have any one of a number of diameters as generally selected to accommodate expected fluid flow in the corresponding portion of drain system 110. In one embodiment, at least sumped flow-through sumped manhole 12 is formed from concrete or another suitable material.

Each of inlet hole 20 and outlet hole 24 are positioned above a bottom 16 of sumped flow-through sumped manhole 12 in a manner creating a sump 26 therebelow. In one example, each of inlet pipe 18 and outlet pipe 22 is positioned a distance from a bottom of the catch basis that is equal to or greater than about one and a half times a smallest inside diameter $D_I$ or $D_O$ of the inlet pipe 18 and the outlet pipe 22, respectively. The respective inside diameters $D_I$ or $D_O$ of inlet pipe 18 and outlet pipe 22 are sized based on where sumped flow-through sumped manhole 12 will be used and associated characteristics thereof, such as expected average and peak flow-rates.

Figure 8:
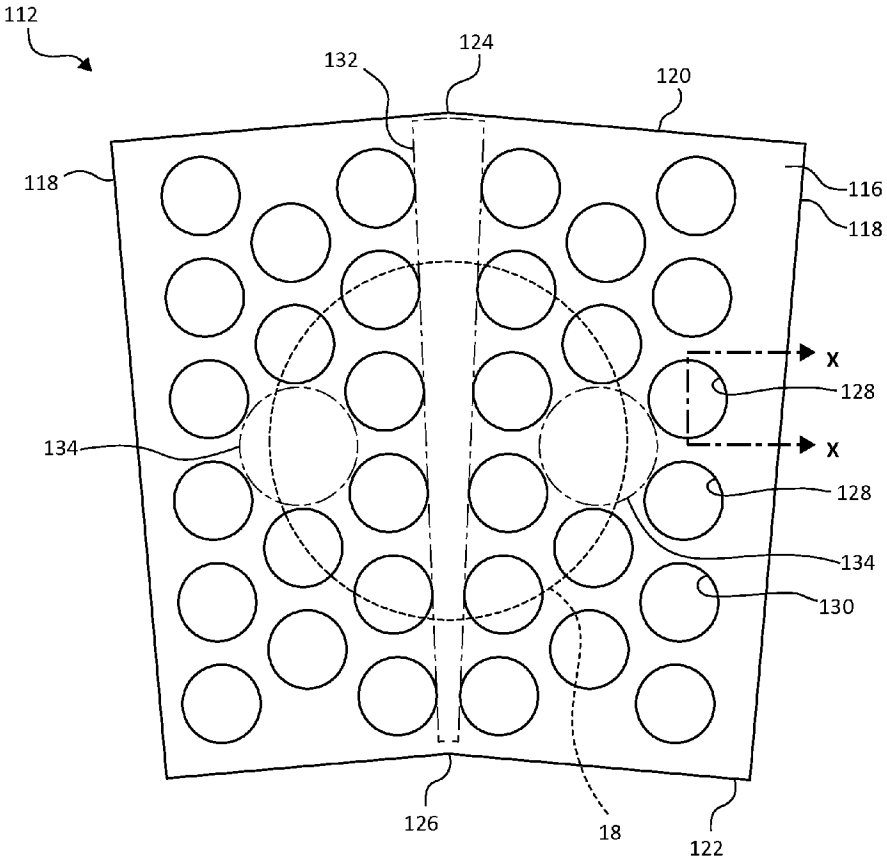
FIG. 8 is a front view of an energy dissipator, according to one embodiment of the present invention.
Figure 10:
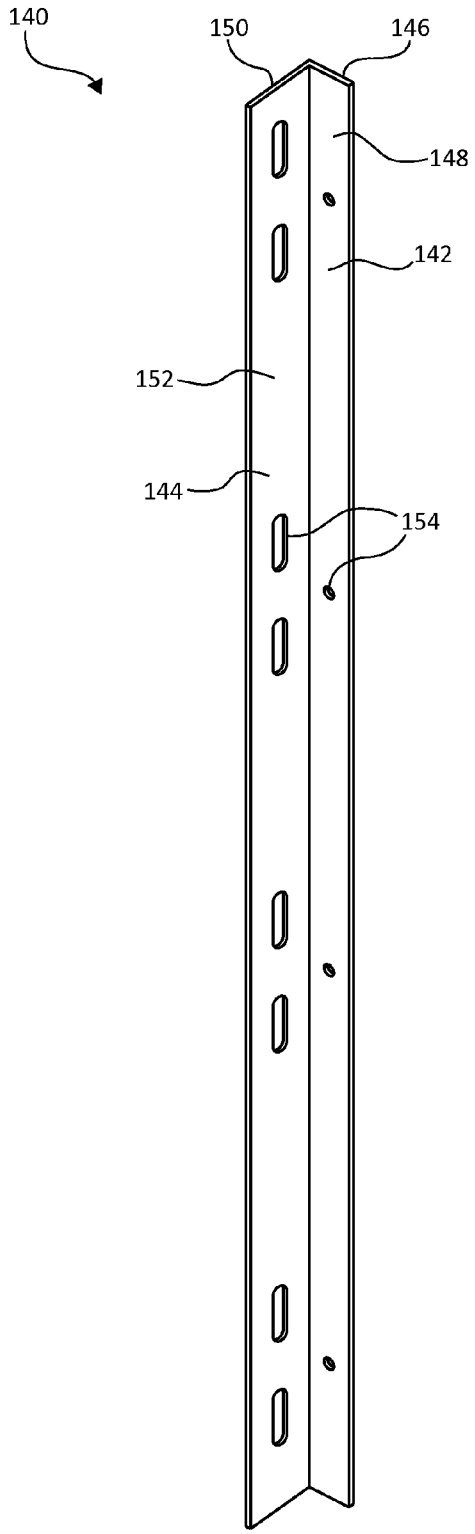
FIG. 10 is a perspective view illustration of an installation bracket for an energy dissipator, according to one embodiment of the present invention.

Dissipator 112 is configured for installation in an arcuate manner relative to inlet pipe 18 as illustrated in FIGS. 5-7 to intercept at least a portion of the fluid flow from inlet pipe 18. One example of dissipator 112 is illustrated in FIG. 8 and is provided in the form of an initially substantially planar sheet of substantially water impervious material, such as a plastic (e.g., recycled or new plastic and/or high density polyethylene), metal (e.g., stainless steel), and fabric (e.g., nylon fabric), defining an upstream surface 114 and a downstream surface 116. While dissipator 112 is sufficiently rigid during fluid flow to reduce the flow energy, in one example, the material forming dissipator 112 is flexible enough to allow dissipator 112 to be rolled for shipping, storage, insertion into sumped manhole 12, etc. In one dissipator 112 can be rolled into a cylinder having a diameter of equal to or less than 21 inches and/or otherwise rolled to slide down into sumped manhole 12 in a single piece.

In one embodiment, dissipator 112 is substantially rectangular defining opposing side edges 118, a top edge 120, and a bottom edge 122. Side edges 118 are substantially linear, and are of substantially equal total height. In one example, side edges 118 are substantially parallel while in other examples, side edges 118 at least slightly converge toward each other the closer side edges 118 are to bottom edge 122. While top and bottom edges 120 and 122 may be entirely linear, in one example, each of top edge 120 and bottom edge 122 angles upwardly to a center point 124 and 126, respectively.

Dissipator 112 decreases flow energy as a fluid flow comes in contact with upstream surface 114 of dissipator 112. However, since dissipator 112 is not designed to fully stop or redirect all of fluid flow, dissipator 112 includes a plurality of perforations or apertures 128 formed therethrough allowing at least a portion of fluid flow to pass through dissipator 112 via such apertures 128. In one example, each aperture of the plurality of apertures 128 is of a similar shape (e.g., are all circular, oval, etc.) and size to others of the plurality of apertures 128; while in other embodiments, the plurality of apertures 128 may include apertures of various shapes and/or sizes. In one instance, apertures 128 are substantially circular in shape without points and/or corners to more evenly distribute forces from fluid moving through and/or being blocked around each aperture 128, so as to reduce a concentration of forces that would be seen in square or otherwise shaped apertures and that may result in tearing or other excess wear of dissipator 112 in such areas. The plurality of apertures 128 are arranged in a staggered pattern, in one example, other than areas specifically configured to not include any of the plurality of apertures 128, as will be further described below.

Figure 9:
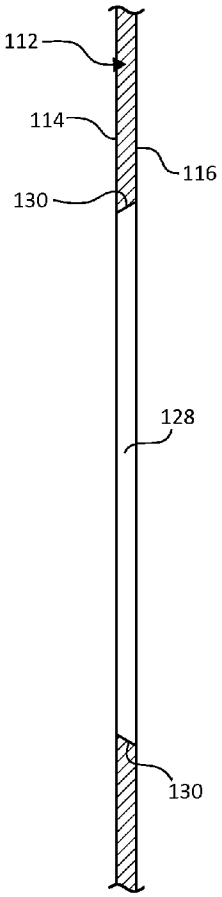
FIG. 9 is a cross-sectional view of the energy dissipator taken along line X-X in FIG. 8, according to one embodiment of the present invention.

Each aperture of the plurality of apertures 128 includes an aperture edge 130 or perimeter edge thereof defining the overall size and shape of each of the plurality of apertures 128. In one example, each aperture edge 130 is formed in the substantially planar material forming dissipator 112 with a beveled orientation as illustrated in the detailed, cross-sectional view of FIG. 9 taken about the line X-X in FIG. 8. More specifically, in the illustrated embodiment, aperture edge 130 tapers toward the upstream surface 114 of dissipator 112, such that each aperture of the plurality of apertures 128 is slightly larger when it intersects downstream surface 116 as compared to when the corresponding aperture intersects upstream surface 114 of dissipator 112. In one example, each aperture edge 130 tapers with an angle of between about 5° and about 60°, for instance, at about a 10° angle. This beveled or angled formation of aperture edge 130 increases energy losses of fluid contacting upstream surface 114 of dissipator 112. In some instances, apertures 128 are not beveled, for example, where a thickness of dissipator is less than about one-eight of an inch. In one embodiment, each aperture 128 has a diameter between about three inches and about twelve inches, for example, of about five to about six inches in diameter to allow passage of larger trash items, such as plastic bottles, therethrough.

In order to decrease energy of the fluid flow in an effective manner, in one example, the plurality of apertures 128 are arranged to define one or more of a center blocking area 132 and/or a side blocking area 134 that are each void of any of the plurality of apertures 128, but rather provide solid, continuous presentations of the material forming dissipator 112. According to one embodiment, and as illustrated in FIG. 8, for example, center blocking area 132, otherwise known as center block column, is provided along a substantially vertical (or upright) center of dissipator 112 to deflect influent high energy flow jet from inlet pipe 18. In one instance, center blocking area 132 is centered between opposing side edges 118 of dissipator 112. Center blocking area 132 presents at least an upright or top-toward-bottom center line having a height equal to at least the inside diameter $D_I$ of inlet pipe 18 (generally indicated in hidden lines in FIG. 8) and, in one example, having a height equal to about one and one half times inside diameter $D_I$, such as an entire height of dissipator 112.

In one example, center blocking area 132 has a consistent width along its entire height while. In another example, center blocking area 132 tapers inwardly as center blocking area 132 extends from near top edge 120 to near bottom edge 122 of dissipator 112. Center blocking area 132 with the tapered shape further promotes the dissipation of energy from related fluid flow by deflecting larger portions of the influent high energy flow jet increases, that is as fluid flow from inlet pipe 18 interacts with higher portions of dissipator 112.

In one example, dissipator 112 also defines side blocking areas 134 positioned on opposing sides of center blocking area 132. Side blocking areas 134 present substantially solid portions of dissipator 112 free from any of the plurality of apertures 128. Side blocking areas 134 are configured to be positioned within the inside diameter $D_I$ of inlet pipe 18 near, and, in one example, extending beyond, an inside perimeter of inlet pipe 18 to block fluid flow at right and left sides thereof as the fluid rushes from inlet pipe 18. Side blocking areas 134 are sized and shaped in any suitable manner, and in one embodiment, are each sized larger than any ones of the plurality of apertures 128. In one example, center blocking area 132 and side blocking areas 134 are both present and serve to block fluid flow at positions in each of four quadrants (that is, positions about 90° offset from each other) of the fluid flow path during high flow rates, that is of the inside diameter $D_I$ of inlet pipe 18. In one example, dissipator 112 is formed with a total open area of between about 20% and 40%, for example, between about 25% and 35%.

Dissipator 112 is sized at least in part based on the value of the inside diameter $D_I$ of inlet pipe 18 so dissipator 112 can be placed to at least partially intercept substantially all fluid flow from inlet pipe 18 even during periods having high flow rates. While dissipator 112 is generally larger than the inside diameter $D_I$ of inlet pipe 18, in one example, dissipator 112 has a height equal to at least about one and one half times the inside diameter $D_I$ of inlet pipe 18, and in another example, is equal to at least about two times the inside diameter $D_I$ of inlet pipe 18. An overall width of dissipator 112 is also generally at least partially based on the inside diameter $D_I$ of inlet pipe 18. In one example, a width of dissipator 112 is equal to at least about one and one half times the inside diameter $D_I$ of inlet pipe 18, and in another example, is equal to at least about two times the inside diameter $D_I$ of inlet pipe 18.

Dissipator 112 is installed in sumped manhole 12 in any suitable manner that generally couples opposing side edges 118 of dissipator 112 in a substantially vertical orientation in sumped manhole 12 on each of opposing sides of inlet pipe 18 resulting in a curved or bowed dissipator 112. In one example, angled brackets 140 are used on either side of dissipator 112 to facilitate coupling with sumped manhole 12, however, use of other installation fasteners and/or brackets are also contemplated. Each bracket 140 generally includes a first leg 142 and a second leg 144 angled relative to one another, for example, at an angle of about 90°. With first leg 142 defining an exterior surface 146 and an opposing interior surface 148, and second leg 144 defining an exterior surface 150, which intersects with exterior surface 146, and an opposing interior surface 152, which intersects with interior surface 148. Each of first and second legs 142 and 144 includes a plurality of apertures 154 to receive fasteners, such as fasteners 158 and 160 (see FIG. 11). In one example, apertures 154 are provided to first leg 142 and/or second leg 144 in a redundant manner, that is, with more apertures 154 than will be needed, to allow the installer to select which of apertures 154 are best suited to a particular installation, e.g., to decide which apertures 154 will not be impeded by features along inside surface 156 of sumped manhole 12 and/or will hit a solid portion of dissipator 112.

In one example, dissipator 112 is installed into a sumped manhole 12 previously installed as part of a storm water treatment system 110 while, in other example, dissipator 112 is installed into a new sumped manhole 12 prior to installation of sumped manhole 12 as part of a storm water treatment system. According to one example, installation begins with installing brackets 140 as illustrated with additional references to FIG. 11. Second leg 144 of each bracket 140 is positioned against inside surface 156 of sumped manhole 12 on an opposing side of inlet pipe 18 such that exterior surface 146 of first leg 142 faces toward inlet pipe 18. In one embodiment, each bracket 140 has a height substantially identical to a height of a side edge 118 of dissipator 112, and therefor is coupled to sumped manhole in a position to correspond with a desired position of dissipator 112. In one example, a bottom of each bracket 140 is positioned a distance below the bottommost point of an outside surface of inlet pipe 18 that is equal to at least about 35% of the inside diameter $D_I$ of inlet pipe 18. In one example, a top of each bracket 140 is positioned a distance above a topmost point of the outside surface of inlet pipe 18 that is equal to at least about 35% of the inside diameter $D_I$ of inlet pipe 18, e.g., a distance substantially equal to the distance the bottom of bracket 140 is positioned from a bottommost point of the outside surface of inlet pipe 18.

In one example, each bracket 140 is positioned on inside surface 156 of sumped manhole 12 at an equal, but opposite, distance from a center of inlet pipe 18 and secured thereto using anchors or other suitable fasteners 160. In one example, at least one fastener 160 is thread through an aperture 154 in second leg 144 of bracket 140 at each of top and bottoms halves of bracket 140. Additional fasteners 160 are generally used along the length of bracket 140. In one example, upon installation, each bracket 140 extends with a substantially vertical orientation within sumped manhole 12.

Once brackets 140 are positioned and coupled to sumped manhole 12, dissipator 112 is installed. More specifically, in one example, downstream surface 116 of dissipator 112 is placed to abut exterior surface 146 of first leg 142 of each bracket 140 along each of opposing side edges 118 of dissipator 112. Aligning dissipator 112 with brackets 140 includes aligning at least one of a top edge 120 and a bottom edge of dissipator with tops or bottoms of brackets 140, in one embodiment. Fasteners 158, such as screws, are inserted through each first leg 142 of brackets 140 and into dissipator 112. When so installed, dissipator 112 curves or bows outwardly away from inlet pipe 18 between opposing side edges 18 thereof in a substantially semi-cylindrical shape. Dissipator 112 is generally open at a top and a bottom thereof, e.g., to allow for trash in the fluid flow to fall to sump 26. In one example, a center line of dissipator 112 is positioned at least about one foot or one half of inside diameter $D_I$ of inlet pipe 18, whichever is greater, further into sumped manhole 12 than the end of inlet pipe 18 in sumped manhole 12. The space between inlet pipe 18 and dissipator 112 allows for easier cleaning of inlet pipe 18 from within sumped manhole 12. The curved installation of dissipator 112 allows dissipator 112 to be placed closer to inlet pipe 18, which, in turn, provides additional open area in sumped manhole 12 on a side of dissipator 112 opposite inlet pipe 18. The additional open area within sumped manhole 12 makes access to sump 26 easier during maintenance of sumped manhole 12.

Figure 11:
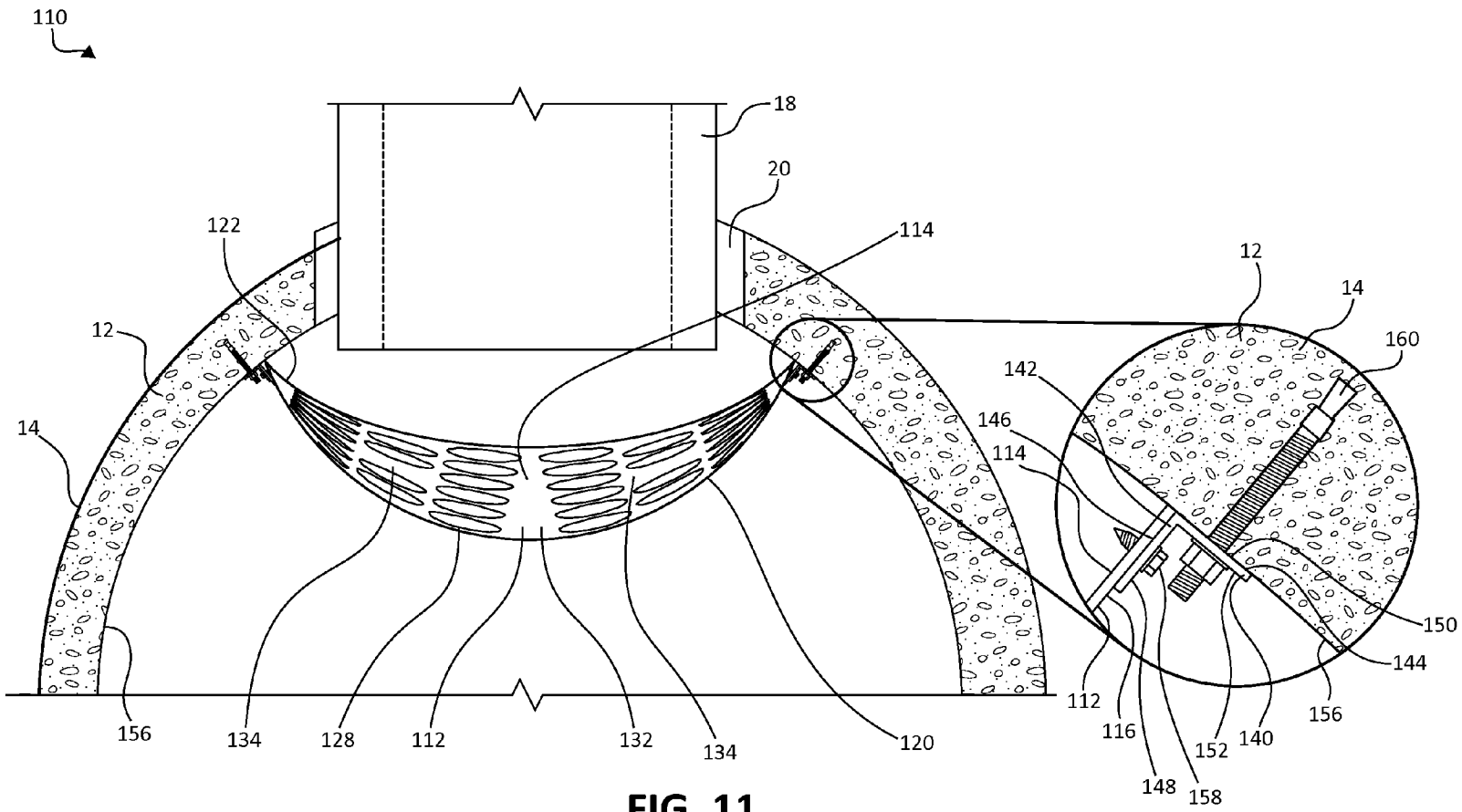
FIG. 11 is an enlarged top view of a portion of the drain system of FIG. 6 with additional inset installation detail, according to one embodiment of the present invention.
Figure 12:
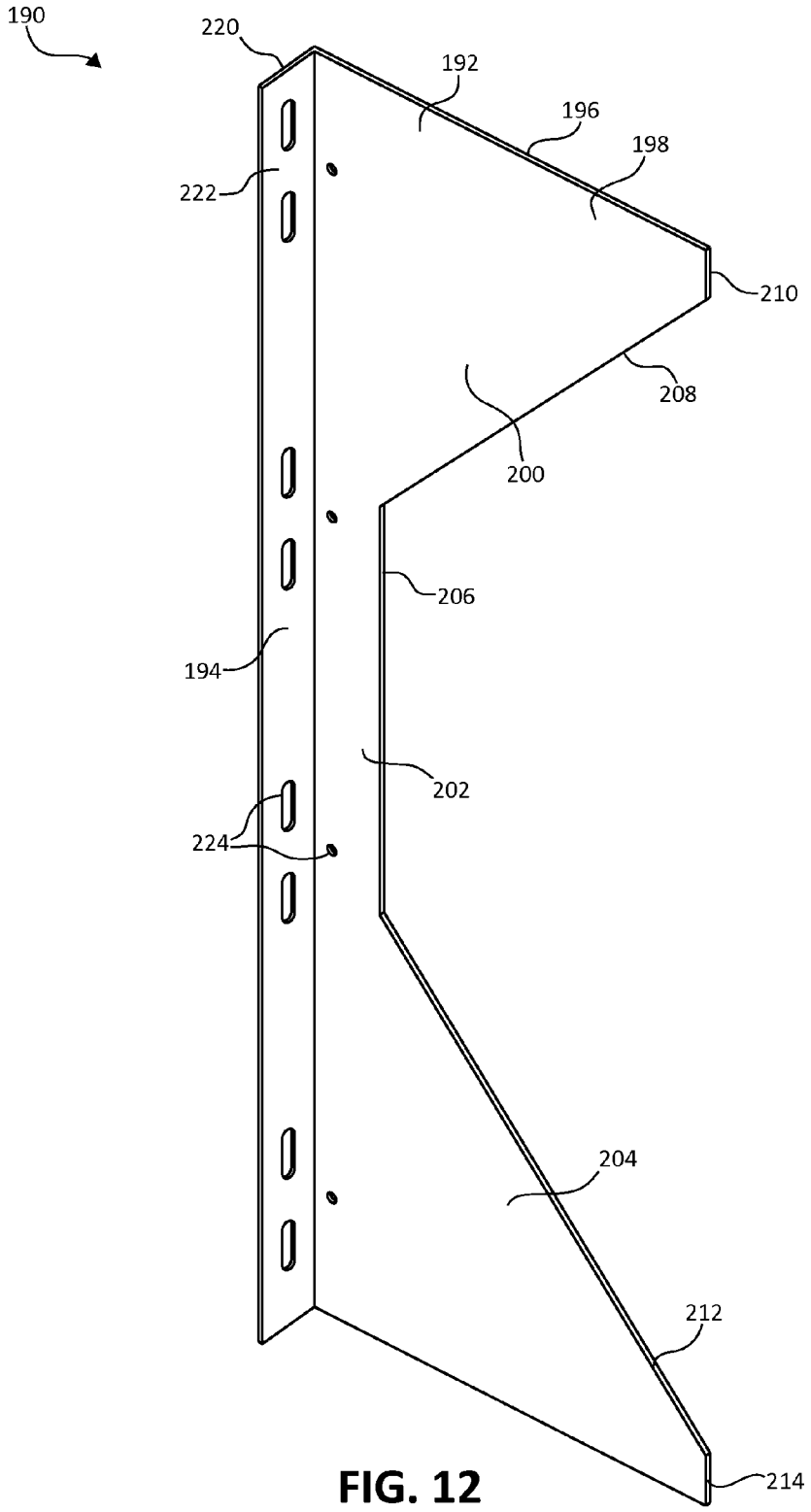
FIG. 12 is a perspective view illustration of an installation bracket for a floatables skimmer, according to one embodiment of the present invention.

Due to the convergence of side edges 118 of dissipator 112 as they near bottom edge 122 thereof (see FIG. 8), the above-described installation of dissipator 112 results in an angled, rather than more nearly vertical, installation of dissipator 112, as generally shown in FIG. 11 and as indicated by angle θ in FIG. 7. In one example, the angle θ is between about 2.5° and about 5°. The angled installation of dissipator 112 allows for fluids blocked by top portions of dissipator 112 to fall due to gravity and still possibly move through dissipator 112 via a lower one of the plurality of apertures 128 formed in dissipator 112. In this manner, less fluid flow moves from inlet pipe 18 entirely below dissipator 112, which decreases introduction of additional flow turbulence or forces that could cause scour of any sediment that may be collected in sump 26 below. The angled orientation of dissipator 112 relative to inlet pipe 18 also allows for easier access to inlet pipe 18 for cleaning and/or other maintenance. In one example, due to upwardly angular nature of top edge 120 to center point 124, upon installation of dissipator 112 with angle θ, top edge 120 extends in a more nearly horizontal manner than if top edge 120 were entirely linear.

Dissipators 112 configured and installed as described herein have been shown to greatly decrease and nearly eliminate scour within sumped manholes 12. In one example, use of dissipator 112 was found to limit the sediment effluent concentration to about 10 mg/l to about 15 mg/l as compared to standard sumped manholes without dissipator 112, which have sediment effluent concentration levels between about 150 mg/l to about 600 mg/l. In this manner, use of dissipator 112 has been shown to decrease sediment effluent concentration by over 90%, for example, from between about 93% to about 98%.

While introduction of dissipator 112 alone introduces benefits in decreasing fluid flow energy, in one example, dissipator 112 is used within drain system 110 along with an optional floatables skimmer 170. One embodiment of skimmer 170 is illustrated with reference to FIGS. 5-7 in which skimmer is formed of a planer material cut, for example, into a substantially rectangular shape and being substantially impervious to water. For example, skimmer 170 may be formed of plastic, such as high-density polyethylene of a new or recycled variety, metal, such as stainless steel, or other suitable material. Skimmer 170 is substantially planar and includes an upstream surface 172 and an opposite downstream surface 174 with opposing side edges 176, a top edge 178, and a bottom edge 180 opposite top edge 178.

Skimmer 170 is coupled to inside surface 156 of sumped manhole 12 using an installation bracket 190, in one embodiment. Installation bracket 190 may be of any suitable size and shape, for example, similar to bracket 140. In the illustrated embodiment, installation bracket 190 generally includes a first leg 192 and a second leg 194 angled relative to first leg 192, for example, at an angle of about 90°. First leg 192 defines an exterior surface 196 and an opposing interior surface 198. In one example, instead of first leg 192 being provided in a general rectangular shape like bracket 140, first leg 192 includes a top segment 200, an intermediate segment 202, and a bottom segment 204. Intermediate segment 202 is generally rectangular and is narrow in width forming a free longitudinal edge 206 opposite second leg 194. Top segment 200 extends upwardly from intermediate segment 202 defining a free angled edge 208 thereof, angled outwardly away from free longitudinal edge 206 of intermediate segment 202, to free edge 210 adjacent a top of installation bracket 190. Bottom segment 204 extends from intermediate segment 202 in a manner substantially symmetrical with top segment 200 to define a free edge 212 angled outwardly away from second leg 194 to a free edge 214 adjacent a bottom of installation bracket 190.

Second leg 194 defines an exterior surface 220, which intersects with exterior surface 196, and an opposing interior surface 222, which intersects with interior surface 198. At least second leg 194, and, in one example, first leg 192, includes a plurality of apertures 224 to receive fasteners, such as fasteners 228 and 230 (see FIG. 13). In one example, apertures 224 are provided through first leg 192 and/or second leg 194 in a redundant manner, that is, with more apertures 224 than will be needed, to allow the installer to select which of apertures 224 are best suited to a particular installation, e.g., to decide which apertures 224 will not be impeded by features along inside surface 156 of sumped manhole 12.

Figure 13:
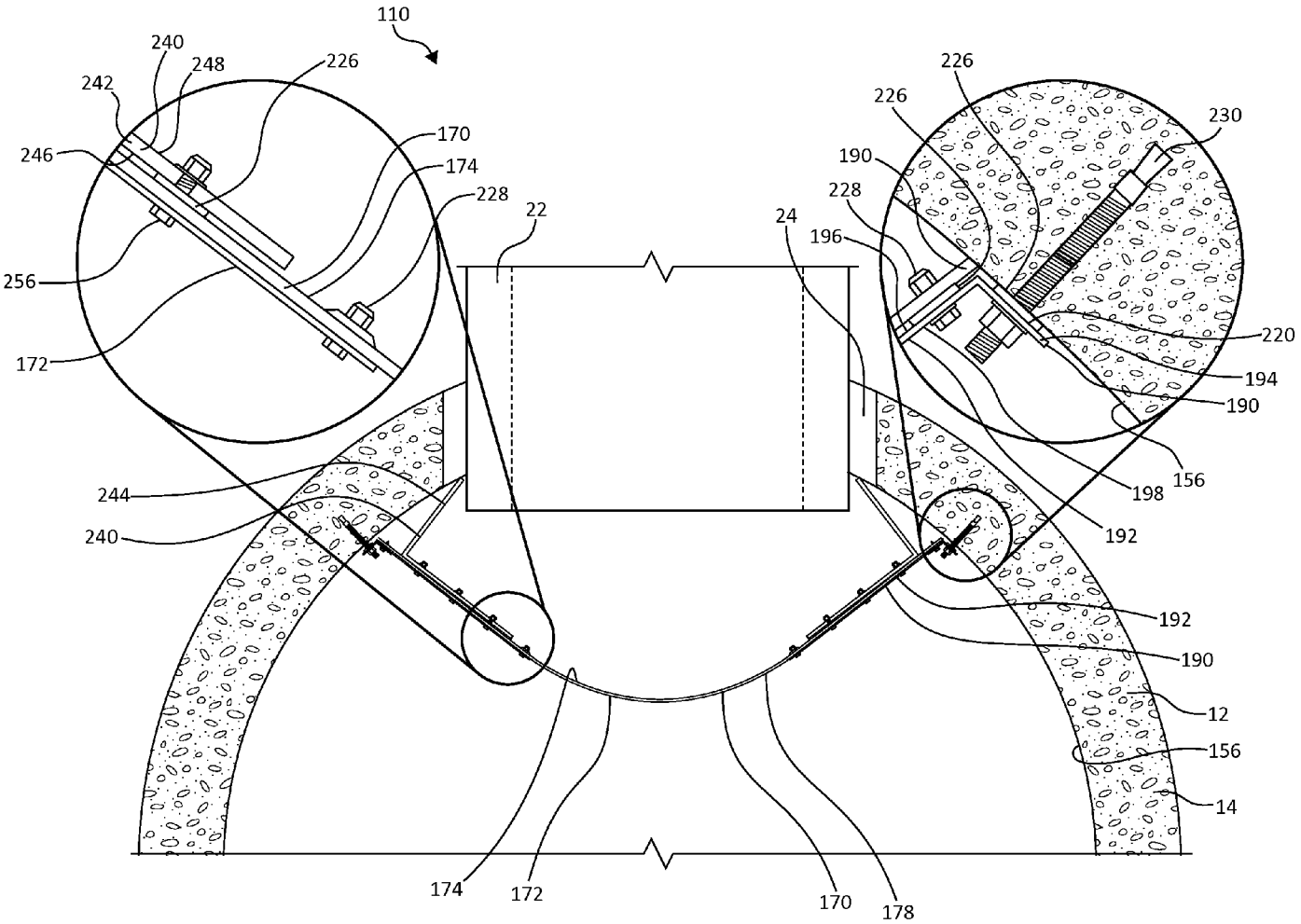
FIG. 13 is an enlarged top view of a portion of the drain system of FIG. 6 with additional inset installation detail, according to one embodiment of the present invention.

During one example, installation of skimmer 170 begins with installing brackets 190, as illustrated with additional references to FIG. 13. Second leg 194 of each installation bracket 190 is positioned against inside surface 156 of sumped manhole 12 on an opposing side of outlet pipe 22 such that exterior surface 196 of first leg 192 faces toward outlet pipe 22. In one embodiment, each installation bracket 190 has a height substantially identical to a height of a side edge 176 of skimmer 170, and therefor is coupled to sumped manhole in a position to correspond with a desired position of skimmer 170. In one example, a bottom of each installation bracket 190 is positioned a distance below the bottommost point of an outside surface of outlet pipe 22 that, in one embodiment, is equal to about one half of the inside diameter $D_O$ of outlet pipe 22. In one example, a top of each installation bracket 190 is positioned a distance above outlet pipe 22 equal to at least about one half of the inside diameter $D_O$ of outlet pipe 22, e.g., a distance substantially equal to the distance the bottom of installation bracket 190 is positioned from a bottommost point of inlet pipe 18.

In one example, brackets 190 are positioned to face inside surface 156 of sumped manhole 12 at equal distances one either side of pipe 22 as measured from a center of outlet pipe 22 and are secured thereto using anchors or other suitable fasteners 230. The equal distance from a center of outlet pipe 22 to one of brackets 190 is equal at least to inside diameter DO of outlet pipe 22, according to one example. In one embodiment, a rubber gasket 226 or other suitable water-sealing agent is placed between installation bracket 190 and inside surface 156 of sumped manhole 12 as illustrated in FIG. 13. In one example, at least one fastener 230 is thread through an aperture 224 in second leg 194 of installation bracket 190 at each of top and bottoms halves of installation bracket 190. Additional fasteners 230 are generally used along the length of installation bracket 190. In one example, upon installation, each installation bracket 190 extends with a substantially vertical orientation within sumped manhole 12.

Once brackets 190 are positioned and coupled to sumped manhole 12, skimmer 170 is installed. More specifically, in one example, upstream surface 172 of skimmer 170 is placed to face exterior surface 196 of first leg 192 of each installation bracket 190 along each of opposing side edges 176 of skimmer 170. Aligning skimmer 170 with brackets 190 includes aligning at least one of a top edge 178 and a bottom edge 180 of skimmer 170 with tops or bottoms of brackets 190, respectively, in one embodiment. Fasteners 228, such as screws, are inserted through each first leg 192 of brackets 190 and into skimmer 170. In one example, rubber gaskets 226 or other water-sealing agent(s) is applied between installation bracket 190 and skimmer 170 to promote watertight installation. When so installed, skimmer 170 curves outwardly away from outlet pipe 22 between opposing side edges 176 thereof, which are maintained adjacent inside surface 156 of sumped manhole. In one example, skimmer 170 is installed in a substantially semi-cylindrical shape that is open at a top and bottom thereof. In one example, skimmer 170 is positioned at least about ⅔ of inside diameter $D_O$ of outlet pipe 22 or about one foot, whichever is greater, from the end of outlet pipe 22 in sumped manhole 12.

Figure 14:
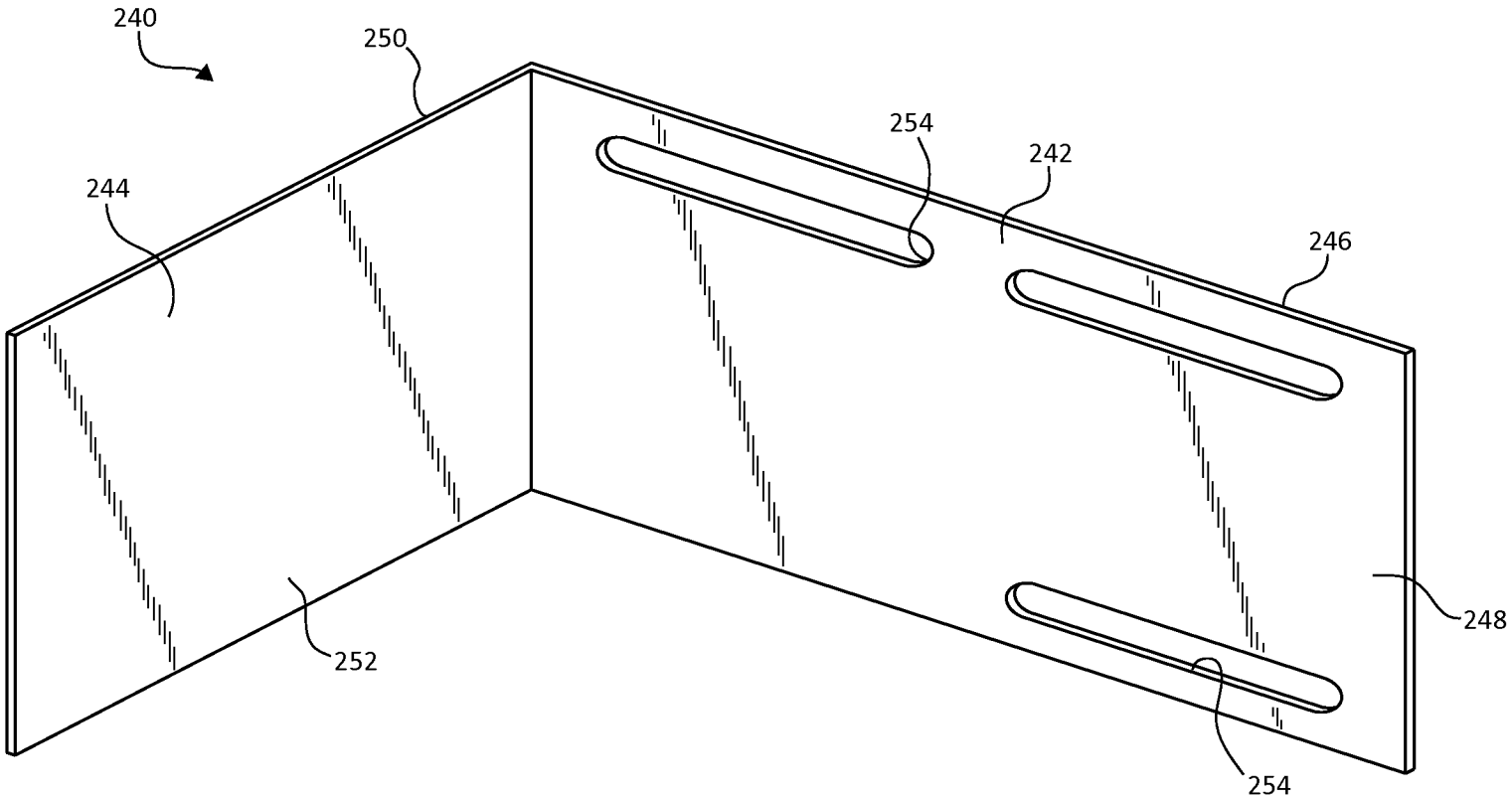
FIG. 14 is a perspective view of a reinforcement bracket for use with a floatables skimmer, accordingly to one embodiment of the present invention.

Upon installation, the enlargement of top and bottom segments 200 and 204 adds rigidity to skimmer 170 holding it to extend initially linearly away from inside surface 156 of sumped manhole 12. This saves wear and tear on skimmer 170, e.g., due to forces of fluid turbulence, allowing skimmer 170 itself to be made of a less rigid material, which may allow skimmer 170 to be rolled to a small size for storage, transport, and/or lowering into sumped manhole 12. In one example, a strengthening bracket 240 is used to further add to the rigidity of skimmer 170 as illustrated in FIGS. 13 and 14. Strengthening bracket 240 generally includes a first leg 242 and a second leg 244 angled relative to one another, for example, at an angle of about 90°. With first leg 242 defining an exterior surface 246 and an opposing interior surface 248, and second leg 244 defining an exterior surface 250, which intersects with exterior surface 246, and an opposing interior surface 252, which intersects with interior surface 248. First leg 242 includes a plurality of apertures 254 to receive fasteners, such as suitable fasteners 256 (see FIG. 13).

Strengthening bracket 240 is coupled to skimmer 170 on an opposite side of skimmer 170, which is facing the downstream surface 174, as compared to installation bracket 190. External surface 246 of strengthening bracket 240 faces upstream and is placed near, but not adjacent to, opposing side edges 176 of skimmer 170. And is coupled to skimmer 170 via screws or other suitable fasteners 256 extending through skimmer 170. In this manner, second leg 244 of strengthening bracket 240 extends downstream from skimmer 170 to interface with inside surface 156 of sumped manhole 12 and/or outside surface of outlet pipe 22, thereby adding additional rigidity to skimmer 170 to reduce deformation thereof even when upstream surface 172 of skimmer 170 is being hit with fluids and face turbulence in heavy flow rates. In one embodiment, strengthening bracket 240 is eliminated and/or all of skimmer 170 is eliminated from drain system 110. In one example, dissipator 112 alone or dissipator 112 in combination with skimmer 170 define a settleable solids management system according to the present invention.

Figure 15:
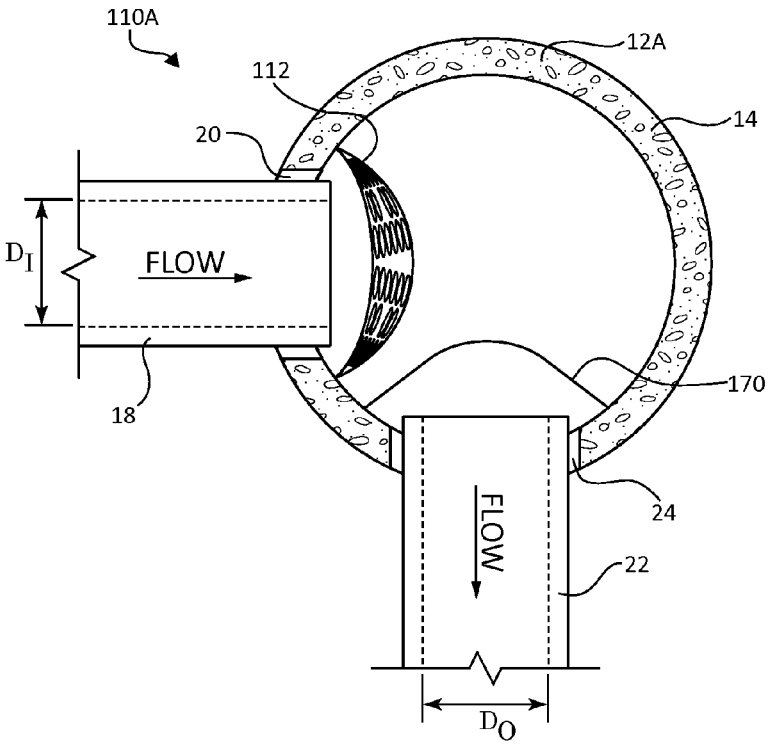
FIG. 15 is a top view of a drain system with a portion of an included sumped manhole removed for illustrative purposes, according to one embodiment of the present invention.
Figure 16:
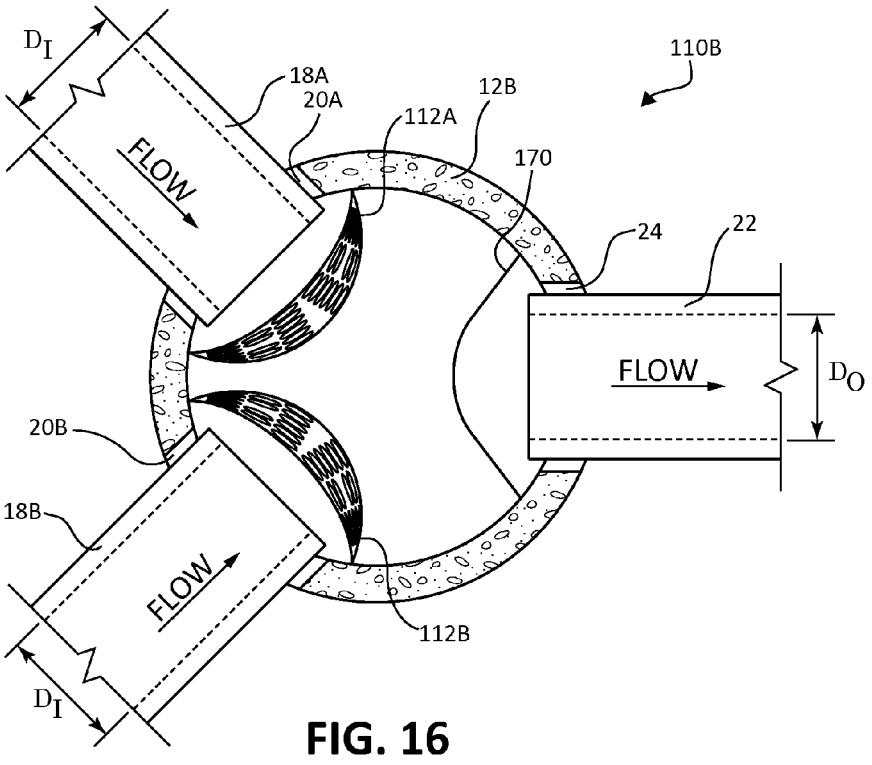
FIG. 16 is a top view of a drain system with a portion of an included sumped manhole removed for illustrative purposes, according to one embodiment of the present invention.

Other embodiments of drain system 110 are also contemplated. For example, other drain systems 110A and 110B, according to the present invention, are shown in FIGS. 15 and 16, respectively. In drain system 110A of FIG. 15, sumped manhole 12A interfaces with inlet pipe 18 and outlet pipe 22 in a manner placing outlet pipe 22 in an angled rather than linear orientation relative to inlet pipe 18, for example, at a substantially 90° angle relative to inlet pipe 18. In drain system 110B in FIG. 16, sumped manhole 12B interfaces with a first inlet pipe 18A, a second inlet pipe 18B, and outlet pipe 22, with each of the two inlet pipes 18A and 18B and outlet pipe 22 being positioned for non-linear flow through. A different, but substantially identical, skimmer 112A and 112B is respectively positioned relative to a different one of first and second inlet pipes 18A and 18B. In one example, one skimmer 112, 112A, or 112B is placed on each inlet pipe 18, 18A, and 18B of sumped manhole 12, 12A, 12B, or other.

The example arrangements of FIGS. 15 and 16 illustrated that the relatively close coupling of dissipator 112, 112A, and/or 112B to a corresponding inlet pipe 18, 18A, and/or 18B allows one or more dissipators to be used in together and/or with skimmer 170. In addition, the close fit of dissipators 112, 112A, and 112B according to the present invention also leaves room in sumped manhole 12, 12A, and 12B for a refuse collector to pass him/herself or tools by the one or more dissipators 112, 112A, and/or 112B to readily access sump 26 and/or perform other internal maintenance of sumped manhole 12, 12A, and/or 12B without requiring removal of the dissipator(s) 112, 112A, and/or 112B to do so.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A drain system comprising:

a sumped manhole including an inlet opening for receiving an inlet pipe and an outlet opening for receiving an outlet pipe;

an energy dissipator comprising:

a sheet member defining a downstream surface, an upstream surface opposite the downstream surface, a top edge, a bottom edge, and opposing side edges each extending between the downstream surface and the upstream surface and between the top edge and the bottom edge, wherein:

the sheet member is initially substantially planar and includes a plurality of apertures, each of the plurality of apertures extends through both the downstream surface and the upstream surface, the opposing side edges of the sheet member taper inwardly toward each other from the top edge toward the bottom edge, each of the opposing side edges is coupled to the sumped manhole on opposing sides of the inlet opening in a substantially vertical orientation such that the sheet member bows away from the inlet opening and the downstream surface extends at an upwardly extending angle of at least about 5° relative to vertical, and the dissipator is configured to intercept a fluid flow within the manhole to decrease energy and control flow dynamics within the manhole.

2. The drain system of claim 1, wherein a center of the energy dissipator is positioned within the greater of about one foot from and about one-half of an inside diameter of the inlet pipe from the inlet pipe.

3. The drain system of claim 1, further including brackets, each of the brackets being coupled to a different one of the opposing side edges of the energy dissipator to facilitate coupling of the energy dissipator to the sumped manhole.

4. The drain system of claim 1, wherein the energy dissipator extends further away from the inlet opening at a longitudinal center thereof than at the opposing side edges.

5. The drain system of claim 1, wherein:

the energy dissipator is closer to the inlet opening at the bottom edge than at the top edge of the energy dissipator.

6. The drain system of claim 1, wherein:

the plurality of apertures are arranged to form a blocking column extending between the top edge and the bottom edge and centered between the opposing side edges, the blocking column is defined as a continuously solid area of the sheet member between the plurality of apertures, and the blocking column tapers inwardly as the blocking column extends from near the top edge toward the bottom edge.

7. The drain system of claim 6, wherein the blocking column continuously tapers inwardly as the blocking column extends from near the top edge toward the bottom edge.

8. The drain system of claim 1, further comprising:

a floatables skimmer coupled to the sumped manhole on opposing sides of the outlet opening.

9. The drain system of claim 8, wherein the floatables skimmer extends away from the outlet hole in an arcuate manner.

10. The drain system of claim 1, wherein:

the sheet member includes a top edge and a bottom edge each extending between the opposing side edges, the plurality of apertures are arranged to form a blocking column extending between the top edge and the bottom edge and centered between the opposing side edges, the blocking column is defined as a continuously solid area of the sheet member between the plurality of aperture, the sheet member defines two side blocking areas each positioned on an opposite side of the blocking column and separated from the blocking column by at least one of the plurality of apertures, and each of the two side blocking areas are defined as a continuously solid area of the sheet member and are sized to be larger than the largest one of the plurality of apertures, and other than the two side blocking areas and the blocking column, ones of the plurality of apertures are spaced from one another a distance less than half a diameter of any one of the plurality of apertures.

11. An energy dissipator for use in a sumped manhole, the energy dissipator comprising:

a sheet member defining a downstream surface, an upstream surface opposite the downstream surface, and opposing side edges each extending between the downstream surface and the upstream surface;

wherein:

the sheet member includes a plurality of apertures, each of the plurality of apertures extends through both the downstream surface and the upstream surface, the sheet member extends in an arcuate manner between the opposing side edges, the dissipator is configured to intercept fluid flow within the manhole to decrease energy and control flow dynamics within the manhole, the sheet member includes a top edge and a bottom edge each extending between the opposing side edges, the plurality of apertures are arranged to form a blocking column extending between the top edge and the bottom edge and centered between the opposing side edges, and the blocking column is defined as a continuously solid area of sheet member between the plurality of apertures and continuously tapers inwardly along each of its longitudinal sides as it extends from near the top edge toward the bottom edge.

12. The energy dissipator of claim 11, further including brackets, each of the brackets being coupled to a different one of the opposing side edges to facilitate coupling of the dissipator to the manhole.

13. The energy dissipator of claim 11, wherein a percent open area of the energy dissipator is less than about 40%.

14. The energy dissipator of claim 11, wherein:

the sheet member additionally defines two side blocking areas, each of the two side blocking areas is positioned on an opposing side of the blocking column and is defined as continuously solid area of sheet material between the plurality of apertures, and each of the two side blocking areas is larger than any one of the plurality of apertures where, other than the blocking column and the two side blocking areas, the plurality of apertures are spaced from one another a distance less than half a diameter of any one of the plurality of apertures.

15. The energy dissipator of claim 11, wherein:

the sheet member defines a top edge and a bottom edge, each of the opposing side edges of the sheet member taper inwardly from the top edge to the bottom edge, each of the opposing side edges is coupled to an inside surface of the sumped manhole on a different one of opposing sides of the inlet opening in a substantially vertical orientation such that the sheet material bows away from the inlet pipe and the downstream surface extends at an upwardly extending angle forming the sheet member with a conical shape.

16. The energy dissipator of claim 11, wherein the plurality of apertures are each formed with a beveled aperture edge such that a diameter of each of the plurality of apertures is larger at the downstream surface than at the upstream surface.

17. The energy dissipator of claim 11 in combination with the sumped manhole.

18. An energy dissipator for use in a sumped manhole, the energy dissipator comprising:

a sheet member defining a downstream surface, an upstream surface opposite the downstream surface, and opposing side edges each extending between the downstream surface and the upstream surface;

wherein:

the sheet member includes a plurality of apertures, each of the plurality of apertures extends through both the downstream surface and the upstream surface, the sheet member extends in an arcuate manner between the opposing side edges, and the dissipator is configured to intercept fluid flow within the manhole to decrease energy and control flow dynamics within the manhole the sheet member includes a top edge and a bottom edge each extending between the opposing side edges, the plurality of apertures are arranged to form a blocking column extending between the top edge and the bottom edge and centered between the opposing side edges, the blocking column is defined as a continuously solid area of sheet member between the plurality of apertures, and the blocking column extends from the top edge to the bottom edge.

19. A method of configuring a sumped manhole to reduce scour within the sumped manhole, the method comprising:

installing an energy dissipator in the sumped manhole, the energy dissipator comprising a sheet member that is initially substantially planar and defines a downstream surface, an upstream surface opposite the downstream surface, a top edge, a bottom edge opposite the top edge, and opposing side edges each extending between the downstream surface and the upstream surface and between the top edge and the bottom edge, each of the two opposing side edges tapers inwardly from the top edge toward the bottom edge, installing the energy dissipator includes securing each of the opposing side edges on opposing sides of an inlet opening in the sumped manhole in substantially vertical orientations to bow the sheet between the side edges such that the sheet member extends in an arcuate manner between the opposing side edges and the downstream edge extends with an upward angle from the bottom edge of the sheet member, and wherein:

the sheet member includes a plurality of apertures, each of the plurality of apertures extends through both the downstream surface and the upstream surface, and the dissipator is configured to intercept fluid flow within the manhole to decrease energy and control flow dynamics within the manhole.

* * * * *